US012539576B2

(12) United States Patent
Al-Sinan et al.

(10) Patent No.: US 12,539,576 B2
(45) Date of Patent: Feb. 3, 2026

(54) MAINTAINING VALVE COMPONENTS

(71) Applicant: Saudi Arabian Oil Company, Dhahran (SA)

(72) Inventors: Hassan Shaker Ali Al-Sinan, Al Qatif (SA); Abdullatif Mohammed Abdulrahman Alomair, Dammam (SA); Ibrahim Ali Al Meftah, Al Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 252 days.

(21) Appl. No.: 18/326,642

(22) Filed: May 31, 2023

(65) Prior Publication Data

US 2024/0399528 A1 Dec. 5, 2024

(51) Int. Cl.

| | |
|---|---|
| ***B24B 37/04*** | (2012.01) |
| ***B24B 15/03*** | (2006.01) |
| ***B24B 47/12*** | (2006.01) |
| ***B24B 51/00*** | (2006.01) |

(52) U.S. Cl.

CPC ..... *B24B 37/042* (2013.01); *B24B 15/03* (2013.01); *B24B 47/12* (2013.01); *B24B 51/00* (2013.01)

(58) Field of Classification Search

CPC ..... B24B 37/00; B24B 37/02; B24B 37/04; B24B 37/042; B24B 37/07; B24B 37/10; B24B 37/105; B24B 37/11; B24B 37/27; B24B 51/00; B24B 15/00; B24B 15/02; B24B 15/03; B24B 47/12

See application file for complete search history.

(56) References Cited

U.S. PATENT DOCUMENTS

| | | | | |
|---|---|---|---|---|
| 2,723,512 A * | 11/1955 | Gibson | ..... | B24B 15/02 451/271 |
| 4,840,057 A | 6/1989 | Bingham | | |
| 5,897,429 A * | 4/1999 | Durovchic | ..... | B24B 15/02 451/430 |
| 2015/0111468 A1* | 4/2015 | Li | ..... | B24B 37/048 451/5 |

FOREIGN PATENT DOCUMENTS

| | | | | |
|---|---|---|---|---|
| CN | 206047872 | 3/2017 | | |
| WO | WO-2010084346 A1 * | 7/2010 | ..... | B24B 15/04 |

* cited by examiner

*Primary Examiner* — C. A. Rivera
(74) *Attorney, Agent, or Firm* — Fish & Richardson P.C.

(57) ABSTRACT

A valve lapping system includes an electric motor at least partially enclosed in a housing; a hollow core coupled to the housing and including a threaded outer surface; a traveling block that includes a hub configured to thread onto the threaded outer surface of the hollow core and a plurality of arms that extend from the hub, with each arm including a channel configured to receive a portion of a valve; a threaded rod that extends through the hollow core and couples to the electric motor; and a bracket coupled to the threaded rod and including an opening sized to receive a lapping block that includes an abrasive surface configured to modify a sealing surface of the valve. The bracket and lapping block are configured to rotate or oscillate, in combination, based on operation of the electric motor to rotate or oscillate the threaded rod.

20 Claims, 14 Drawing Sheets

MAINTAINING VALVE COMPONENTS

TECHNICAL FIELD

The present disclosure relates to apparatus, systems, and methods for maintaining valve components and, more particularly, to apparatus, systems, and methods for lapping a surface of a valve, such as a safety relief valve.

BACKGROUND

Valve lapping refers to a procedure that is used when sealing surfaces of a valve are machined to a smooth finish with the use of an abrasive object. Lapping is the finishing of a surface that has previously been subjected to grinding. The lapping process levels the surfaces where valve components are seated and contact each other. Surfaces where metal is in direct contact with metal tend to wear and it can be important that the seal between the surfaces is tight to prevent leakage of a fluid that circulates through the valve.

SUMMARY

In an example implementation, a valve lapping system includes an electric motor at least partially enclosed in a housing; a hollow core coupled to the housing and including a threaded outer surface; a traveling block that includes a hub configured to thread onto the threaded outer surface of the hollow core and a plurality of arms that extend from the hub, with each arm including a channel configured to receive a portion of a valve; a threaded rod that extends through the hollow core and couples to the electric motor; and a bracket coupled to the threaded rod and including an opening sized to receive a lapping block that includes an abrasive surface configured to modify a sealing surface of the valve. The bracket and lapping block are configured to rotate or oscillate, in combination, based on operation of the electric motor to rotate or oscillate the threaded rod.

In an aspect combinable with the example implementation, the bracket further includes a lock assembly configured to secure the lapping block into the opening and to the bracket.

In another aspect combinable with any of the previous aspects, the portion of the valve includes a flange bolt.

Another aspect combinable with any of the previous aspects further includes a plurality of threaded nuts, each threaded nut configured to thread onto the flange bolt that extends through the channel to secure each arm to the valve.

In another aspect combinable with any of the previous aspects, each arm extends substantially linearly from the hub, or each arm includes an L-shaped arm that extends from the hub.

In another aspect combinable with any of the previous aspects, the hub includes a plurality of arc channels.

In another aspect combinable with any of the previous aspects, each arm is secured to the hub with a bolted connection at one of the arc channels.

In another aspect combinable with any of the previous aspects, each arm is secured to the arm at a radially adjustable location with the bolted connection and the arc connection.

In another aspect combinable with any of the previous aspects, the hub is configured to thread onto the threaded outer surface of the hollow core to adjust a distance between the hub and the housing based on a size of the valve.

Another aspect combinable with any of the previous aspects further includes a controller that includes the electric motor, the controller including a plurality of control buttons.

In another aspect combinable with any of the previous aspects, the controller is configured to perform operations including based on activation of a first control button, turning the electric motor on; and based on activation of a second control button, turning the electric motor off.

In another aspect combinable with any of the previous aspects, the controller is configured to perform operations including based on activation of a third control button, adjusting a rotational speed of the electric motor to adjust a rotational speed of the bracket and the lapping block, in combination, based on operation of the electric motor at the adjusted rotational speed to rotate the threaded rod.

In another aspect combinable with any of the previous aspects, the controller is configured to perform operations including based on activation of a fourth control button, adjusting a rotational direction of the electric motor to adjust a rotational direction of the bracket and the lapping block, in combination, based on operation of the electric motor at the adjusted rotational direction to rotate the threaded rod.

In another example implementation, a valve lapping method includes installing a valve lapping system onto a valve. The valve lapping system includes an electric motor at least partially enclosed in a housing, a hollow core coupled to the housing and including a threaded outer surface, a traveling block that includes a hub threaded onto the threaded outer surface of the hollow core and a plurality of arms that extend from the hub, with each arm including a channel through which a portion of the valve extends, a threaded rod that extends through the hollow core and is coupled to the electric motor, and a bracket coupled to the threaded rod and including an opening into which a lapping block that includes an abrasive surface is secured. The method further includes operating the electric motor to rotate or oscillate the bracket and lapping block, in combination, through rotation or oscillation of the threaded rod by the electric motor; and modifying a sealing surface of the valve with the rotating or oscillating lapping block.

An aspect combinable with the example implementation further includes securing the lapping block into the opening and to the bracket with a lock assembly of the bracket.

In another aspect combinable with any of the previous aspects, installing the valve lapping system includes installing the traveling block onto the valve such that flange bolts of the valve extend through respective channels of the arms; and installing a threaded nut onto each of the flange bolts to secure each arm to the valve.

Another aspect combinable with any of the previous aspects further includes selecting arms of the traveling block that extend substantially linearly from the hub based on a size of the valve, or selecting arms of the traveling block that each includes an L-shaped arm that extends from the hub based on the size of the valve.

In another aspect combinable with any of the previous aspects, the hub includes a plurality of arc channels, and each arm is secured to the hub with a bolted connection at one of the arc channels.

Another aspect combinable with any of the previous aspects further includes adjusting a radial location of each arm in a respective arc channel; and securing each arm to the hub at the location with a bolted connection through the arc channel.

Another aspect combinable with any of the previous aspects further includes threading the hub onto the threaded outer surface of the hollow core to adjust a distance between the hub and the housing based on a size of the valve.

Another aspect combinable with any of the previous aspects further includes activating a first control button to turn the electric motor on; and activating a second control button to turn the electric motor off.

Another aspect combinable with any of the previous aspects further includes activating a third control button to adjust a rotational speed of the electric motor to adjust a rotational speed of the bracket and the lapping block, in combination, based on operation of the electric motor at the adjusted rotational speed to rotate the threaded rod.

Another aspect combinable with any of the previous aspects further includes activating a fourth control button to adjust a rotational direction of the electric motor to adjust a rotational direction of the bracket and the lapping block, in combination, based on operation of the electric motor at the adjusted rotational direction to rotate the threaded rod.

Implementations according to the present disclosure may include one or more of the following features. For example, implementations of valve lapping systems and methods according to the present disclosure can improve a lapping quality of one or more sealing surfaces of a valve, such as a safety relief valve. As another example, implementations of valve lapping systems and methods according to the present disclosure can ensure a continuity of a lapping force applied to a sealing surface of a valve by a lapping block during a lapping operation. As another example, implementations of valve lapping systems and methods according to the present disclosure can minimize a time duration of lapping process. Also, implementations of valve lapping systems and methods according to the present disclosure can avoid human error during a lapping process. Further, implementations of valve lapping systems and methods according to the present disclosure can be more time and cost efficient compared to manual or other automated lapping processes.

The details of one or more implementations of the subject matter described in this disclosure are set forth in the accompanying drawings and the description. Other features, aspects, and advantages of the subject matter will become apparent from the description, the drawings, and the claims.

DETAILED DESCRIPTION

Figure 1B:
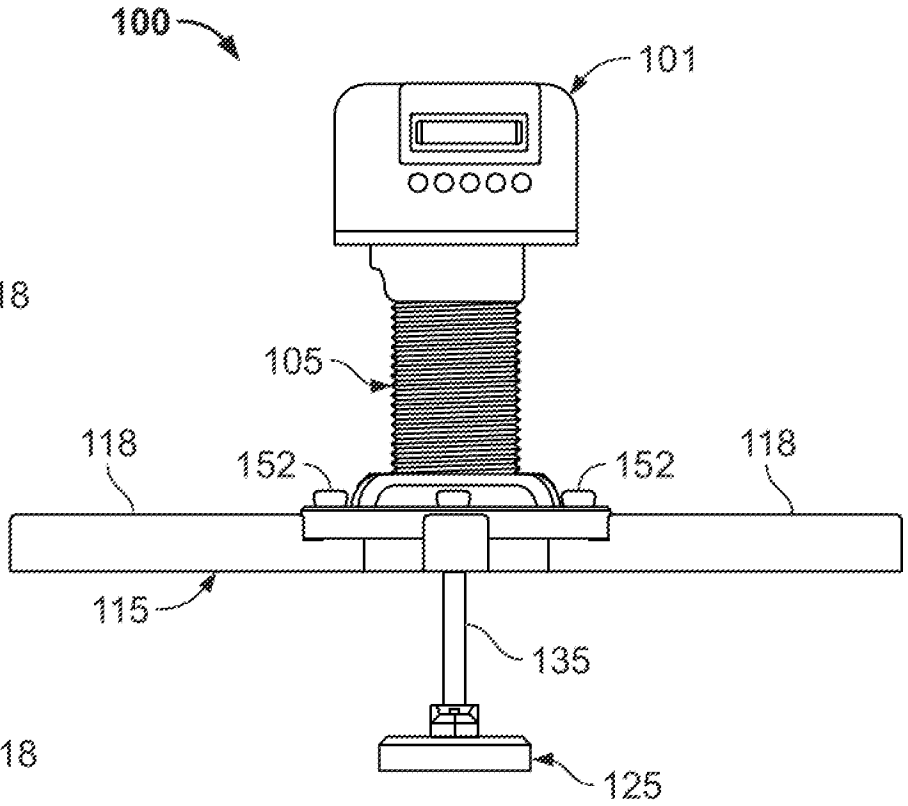
FIGS. 1A-1C illustrate different schematic views of an example implementation of a valve lapping system according to the present disclosure.
Figure 1A:
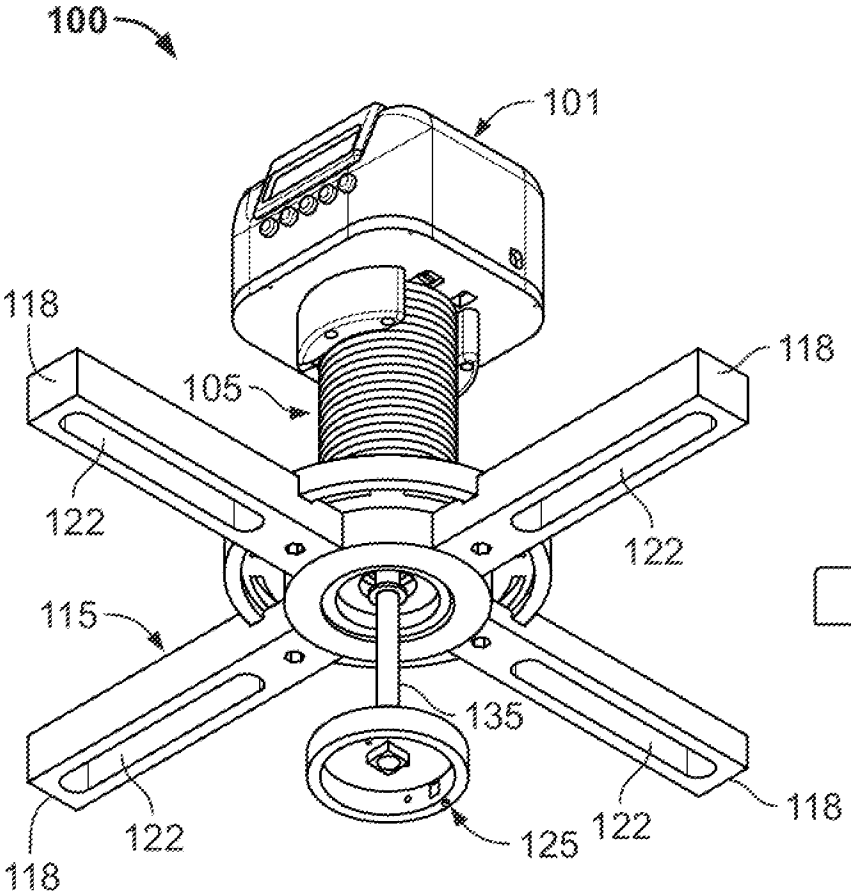
Figure 1C:
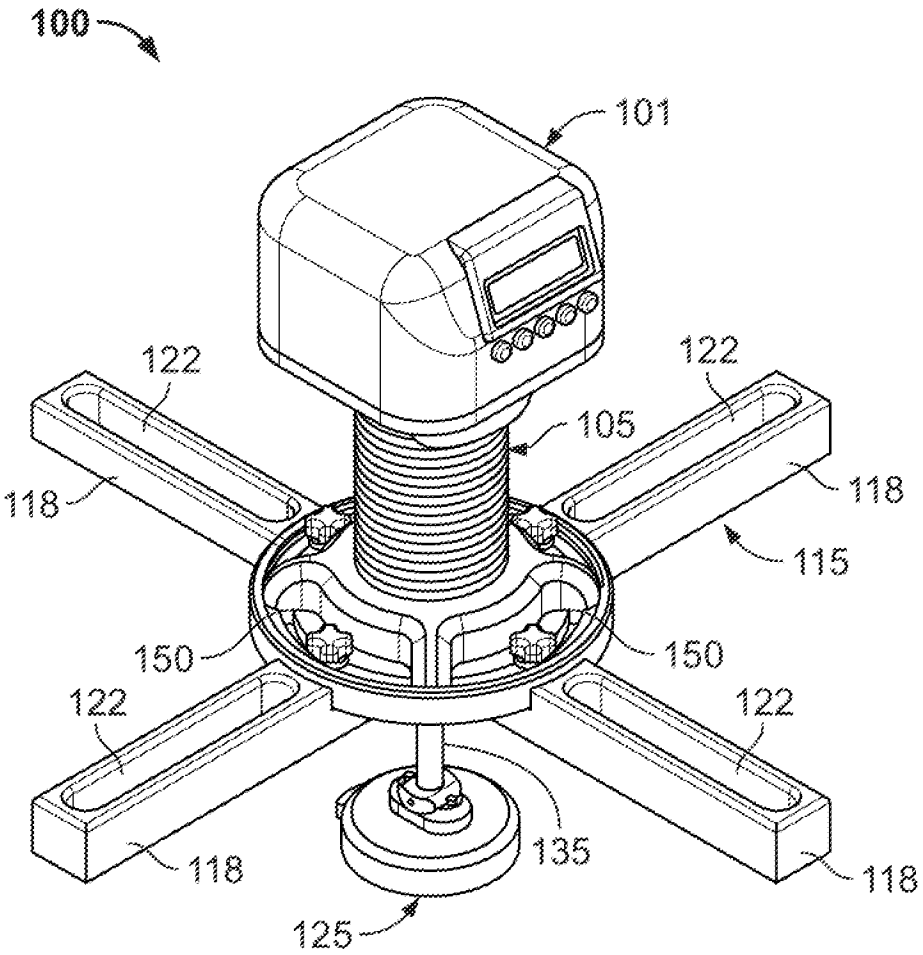

FIGS. 1A-1C illustrate different schematic views of an example implementation of a valve lapping system 100 according to the present disclosure. In some aspects, valve lapping system 100 is an electronic (for example, motorized) valve lapping system that allows for more efficient and timely operation of a lapping block (or plate) to finish (or re-finish) one or more sealing surfaces within a valve, such as a safety relief valve commonly found in hydrocarbon fluid applications (for example, pipelines, drilling and completion systems, refining operations, and otherwise). For example, the valve lapping system 100 can be used in combination with a lapping block (as described more fully herein) to abrasively finish sealing surfaces of a valve to remove damage such as scratches, that, in some cases cause fluid leakage from the valve due to the damage. Example implementations of a valve lapping system such as valve lapping system 100 operate by securing a lapping block into the system and motively rotating the lapping block (for example, through oscillation or rotation in one direction) on a sealing surface inside the valve. In some aspects, a grease compound can be used to flatten the surface of the lapping block to form a more planar surface.

Example implementations of a valve lapping system such as the valve lapping system 100 include a motor (for example, an electric motor such as an adjustable speed motor) and a bracket that secures a lapping block within the system. The bracket is connected to the motor though a shaft and coupling, which can be enclosed within a hollow core and includes a bearing compartment to keep the shaft securely driven by the motor. The example of the valve lapping system 100 can be used in lapping operations on valves of different sizes and with lapping blocks of different sizes.

Utilization of the valve lapping system 100 (and other valve lapping systems described in the present disclosure) can expedite the lapping process as compared to conventional lapping operations. For instance, a relief valve with an imbedded disk requires lapping to even the level in order to repair scratches that could cause a leak. Manual lapping methods require an average of 18 accumulated hours from a technician to finish the lapping for each relief valve. In addition, the manual lapping by a technician may not be precise enough which might affect the repair of the sealing surface. In comparison, the valve lapping system 100, for example, can minimize a lapping operation to less than a fourth of the time of such conventional methods.

In the illustrated example of FIGS. 1A-1C, the valve lapping system 100 includes a controller 101 that is coupled to a hollow core 105. A traveling block 115 is coupled to the hollow core 105 and is operable to move (for example, by threading) along the hollow core 105 in a bi-directional, linear direction so as to account for different valve sizes. A bracket 125 that is operable to secure a lapping block therein is coupled to a threaded rod 135. The threaded rod 135, as described more fully herein, is coupled to an electric motor within the controller 101 to transfer rotational motion from the motor to the bracket 125 (and thus a lapping block) to perform a lapping operation.

As shown in this example (and also in FIGS. 3A-3C), the traveling block 115 includes multiple arms 118 (four in this example) that extend away from the hollow core 105 and include channels 122. The channels 122 can be sized to receive bolts that extend from a valve therethrough, thus allowing the valve lapping system 100 to be secured to the valve during a lapping operation. As channels 122 comprise extended openings, multiple valve sizes can be accommodated by the valve lapping system 100.

As shown in FIGS. 1A-1C (and elsewhere), each arm 118 can be secured to a hub 116 (labeled in FIGS. 3A-3C and 4A and 4B) with a bolted connection 152 that extends through an arc channel 150 and into the arm 118. The bolted connection 152 can be inserted through any portion of the arc channel 150 (with one are channel 150 per arm 118 in this example), thereby allowing radial adjustment of each arm 118 about the hub 116 within the bounds of the arc channels 150.

Figure 2A:
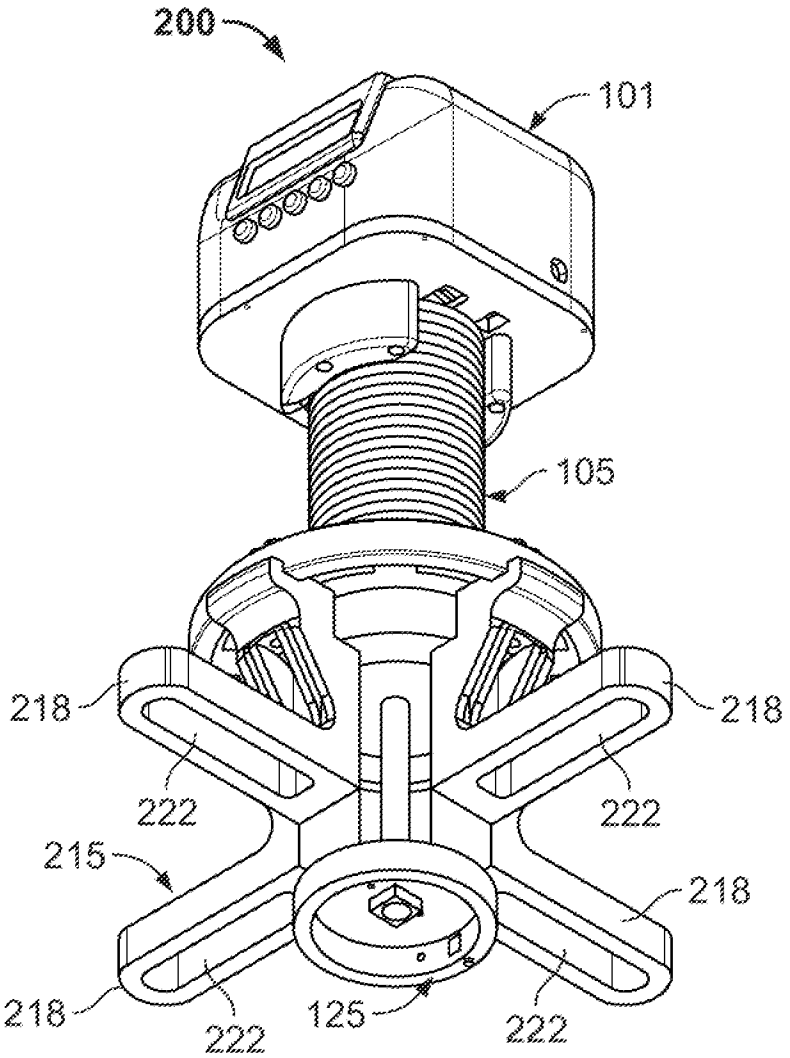
FIGS. 2A-2C illustrate different schematic views of another example implementation of a valve lapping system according to the present disclosure.
Figure 2C:
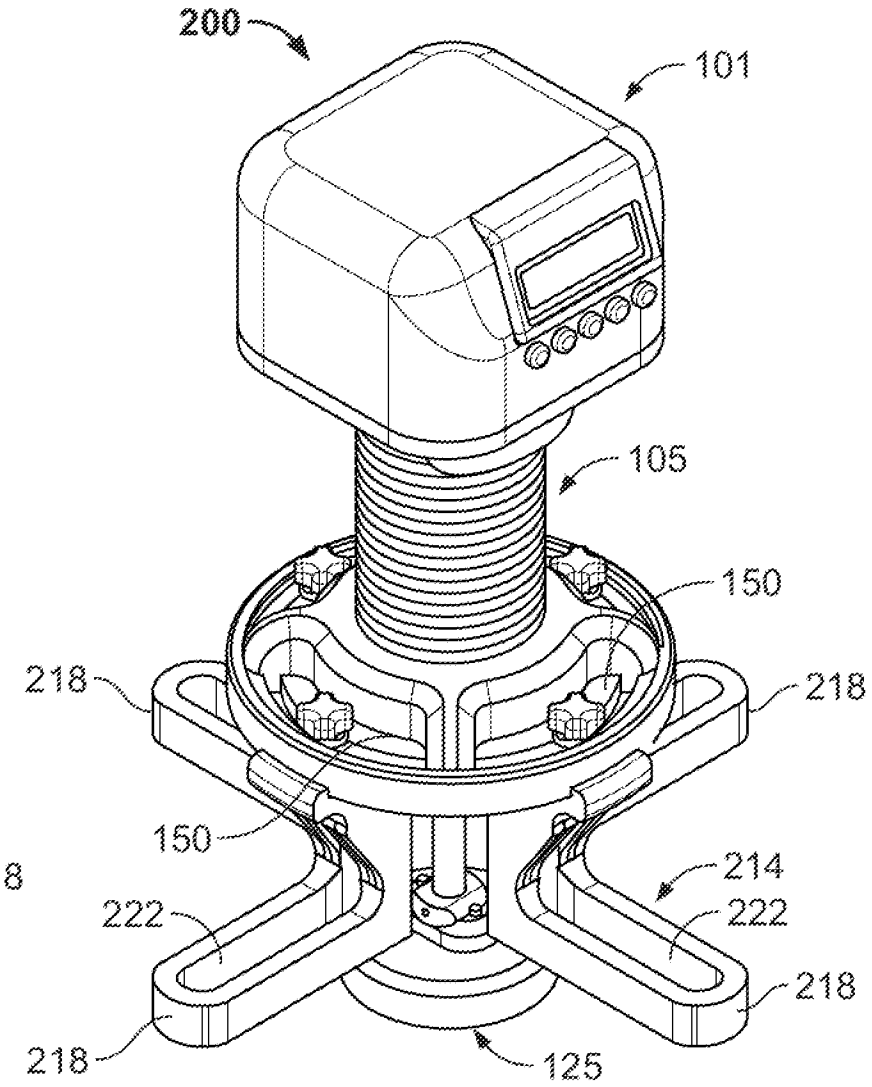
Figure 2B:
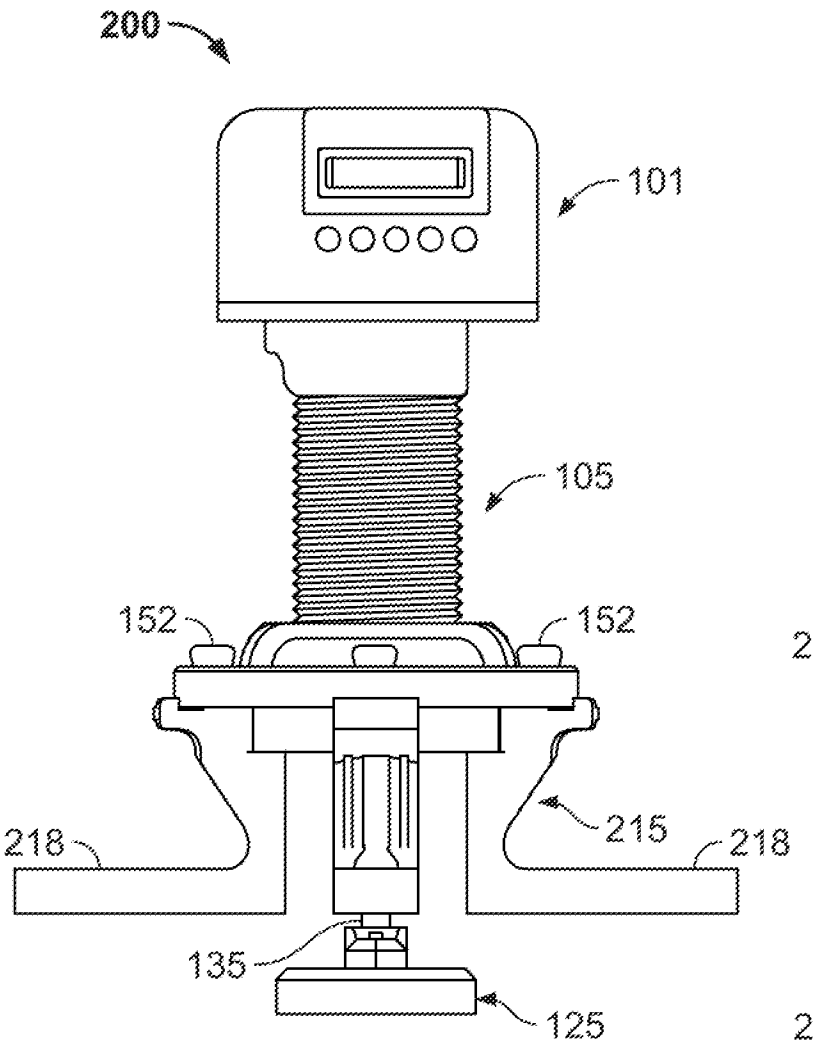

FIGS. 2A-2C illustrate different schematic views of another example implementation of a valve lapping system 200 according to the present disclosure. Generally, valve lapping system 200 is similar to valve lapping system 100 and includes many of the same or similar components (indicated by the same reference numbers as shown in FIGS. 1A-1C). In this example, however, valve lapping system 200 includes a traveling block 215 in which arms 218 are "L" shaped (as shown in FIG. 2B) as compared to substantially linear as shown with arms 118). The arms 218, as shown, also include channels 222. The channels 222 can be sized to receive bolts that extend from a valve therethrough, thus allowing the valve lapping system 200 to be secured to the valve during a lapping operation. As slots 22 comprise extended openings, multiple valve sizes can be accommodated by the valve lapping system 200. Further, as the arms 218 do not extend as far from the hollow core 105 as do arms 118 of valve lapping system 100, the valve lapping system 200 can accommodate valves of different sizes than valve lapping system 100.

As shown in FIGS. 2A-2C (and elsewhere), each arm 218 can be secured to the hub 116 (labeled in FIGS. 3A-3C and 4A and 4B) with the bolted connection 152 that extends through the arc channel 150 and into the arm 218. Like the arms 118, the bolted connection 152 can be inserted through any portion of the arc channel 150 (with one arc channel 150 per arm 218 in this example), thereby allowing radial adjustment of each arm 218 about the hub 116 within the bounds of the arc channels 150.

Figure 3B:
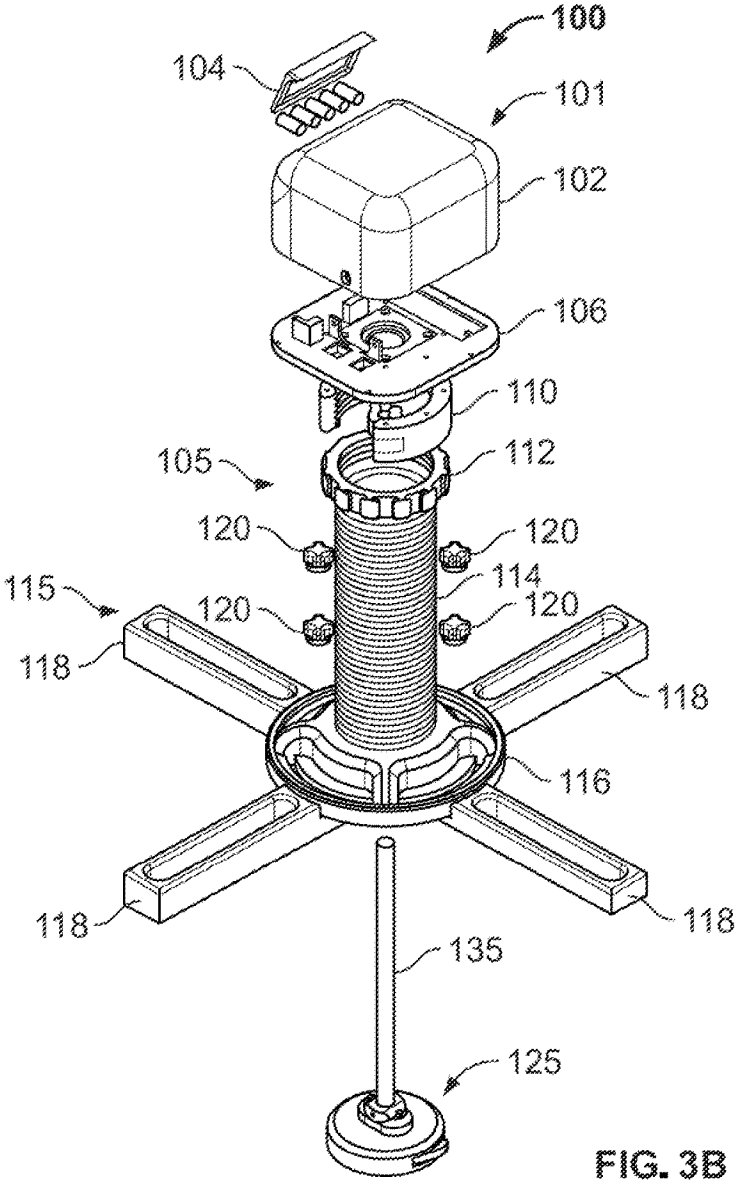
FIGS. 3A-3C illustrate exploded schematic views of an example implementation of a valve lapping system according to the present disclosure.
Figure 3A:
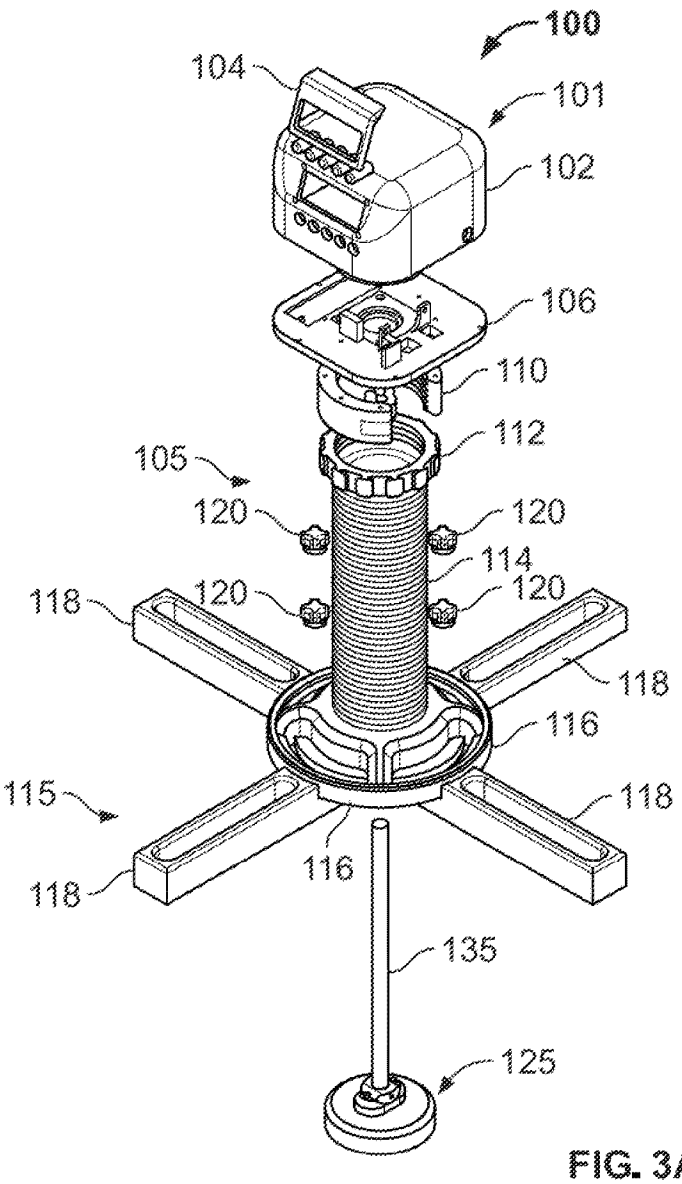
Figure 3C:
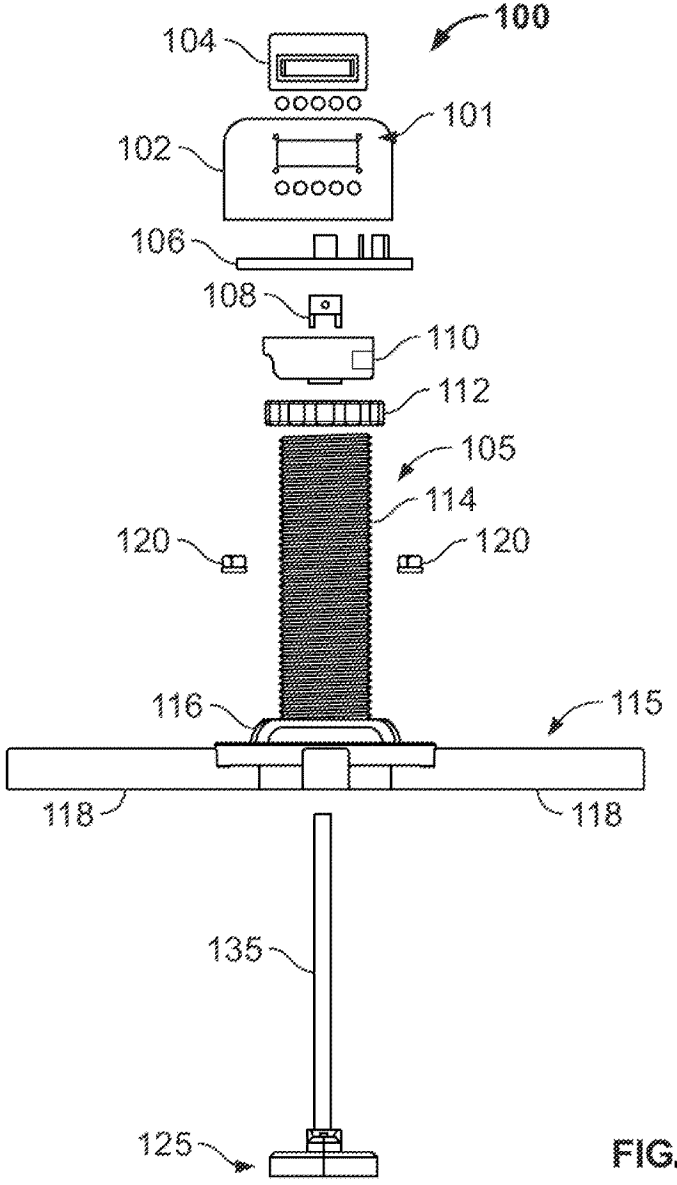

FIGS. 3A-3C illustrate exploded schematic views of the example implementation of the valve lapping system 100 according to the present disclosure. As previously described, the valve lapping system 100 includes the controller 101 that is coupled to the hollow core 105. The traveling block 115 is coupled to the hollow core 105 and is operable to move (for example, by threading) along the hollow core 105 in a bi-directional, linear direction so as to account for different valve sizes. The bracket 125 is operable to secure a lapping block therein and is coupled to the threaded rod 135. The threaded rod 135 can be coupled to an electric motor within the controller 101 to transfer rotational motion from the motor to the bracket 125 (and thus a lapping block) to perform a lapping operation.

Figure 6:
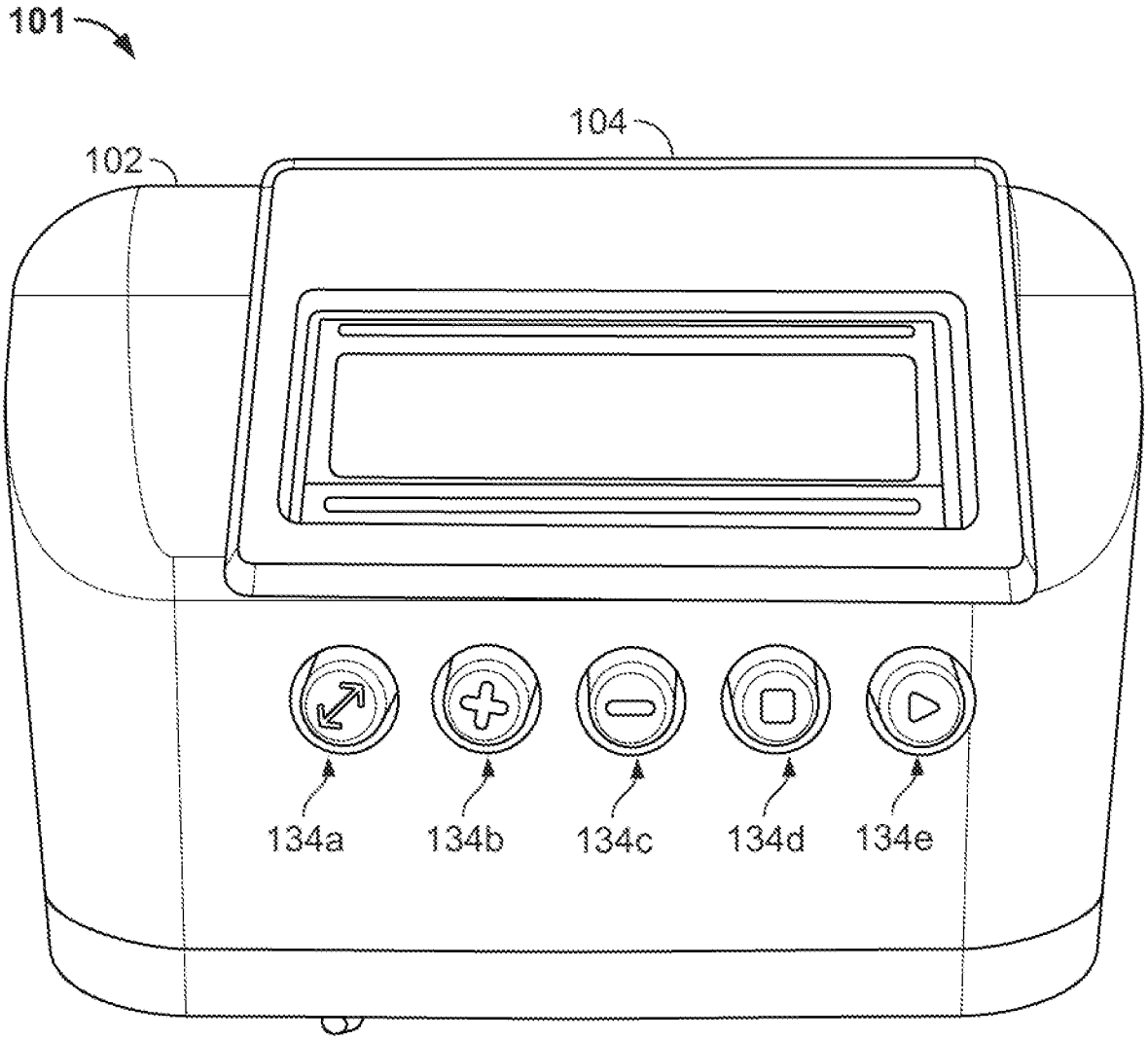
FIG. 6 is a schematic illustration of an example implementation of a control system of a valve lapping system according to the present disclosure.

In this example, controller 101 includes a housing 102, an electric motor (not specifically shown here), a processing system (with motor controller), and a display 104 with control buttons (shown more fully in FIG. 6). In some aspects, the electric motor (shown in FIGS. 4A and 4B) is a stepper motor (for example, NEMA 23 stepper motor) that can be controlled at multiple speeds and in two rotational directions to match a desired speed and direction for a lapping operation.

A controller base 106 fits on a bottom side of the housing 102 to enclose the electric motor and other electronics. As shown in this example, a housing extension 110 is connected to the housing 102 (for example, to the controller base 106) and secures the controller 101 to the hollow core 105. For example, the hollow core 105 includes a threaded surface 114 onto which the housing extension 110 can be threaded to secure the controller 101 to the hollow core 105.

Continuing with FIGS. 3A-3C, the traveling block 115 includes a hub 116 and a coupling 112 that thread onto the threaded surface 114 of the hollow core 105. The arms 118 (previously described) are coupled to and extend from the hub 116. Although arms 118 are shown in this example, arms 218 can also be coupled to the hub 116 to accommodate different valve sizes. Arms 118, as described, include channels 122 (not shown here) through which bolts of the valve can be inserted and secured with nuts 120 to secure the valve lapping system 100 to the valve for a lapping operation.

As shown, the bracket 125 is coupled to the threaded rod 135. The threaded rod 135 can be positioned to extend through the hollow core 105 to couple to the electric motor in the controller 101 (as shown in FIGS. 4A and 4B).

Figure 4A:
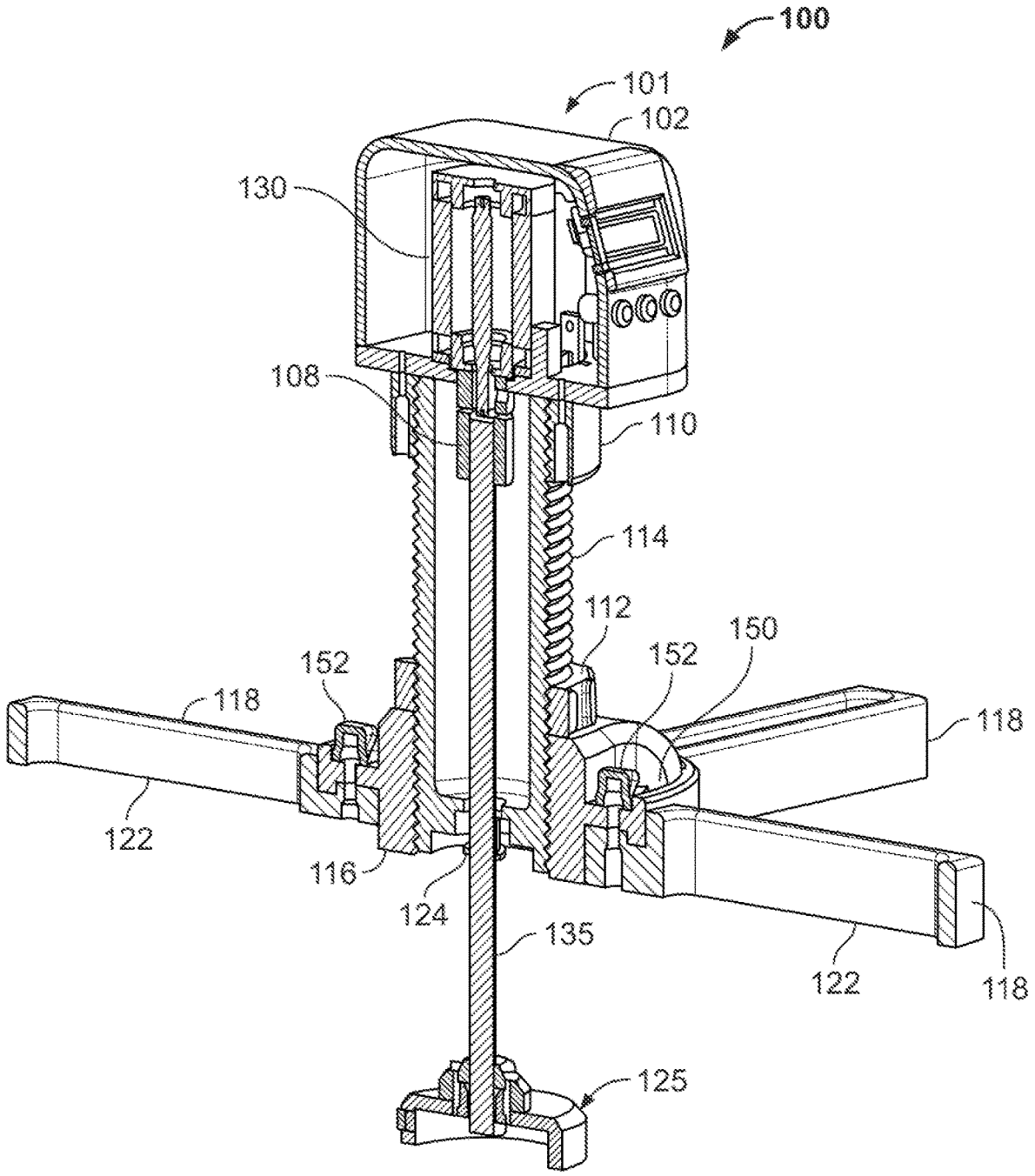
FIGS. 4A and 4B illustrate different cross-sectional views of an example implementation of a valve lapping system according to the present disclosure.
Figure 4B:
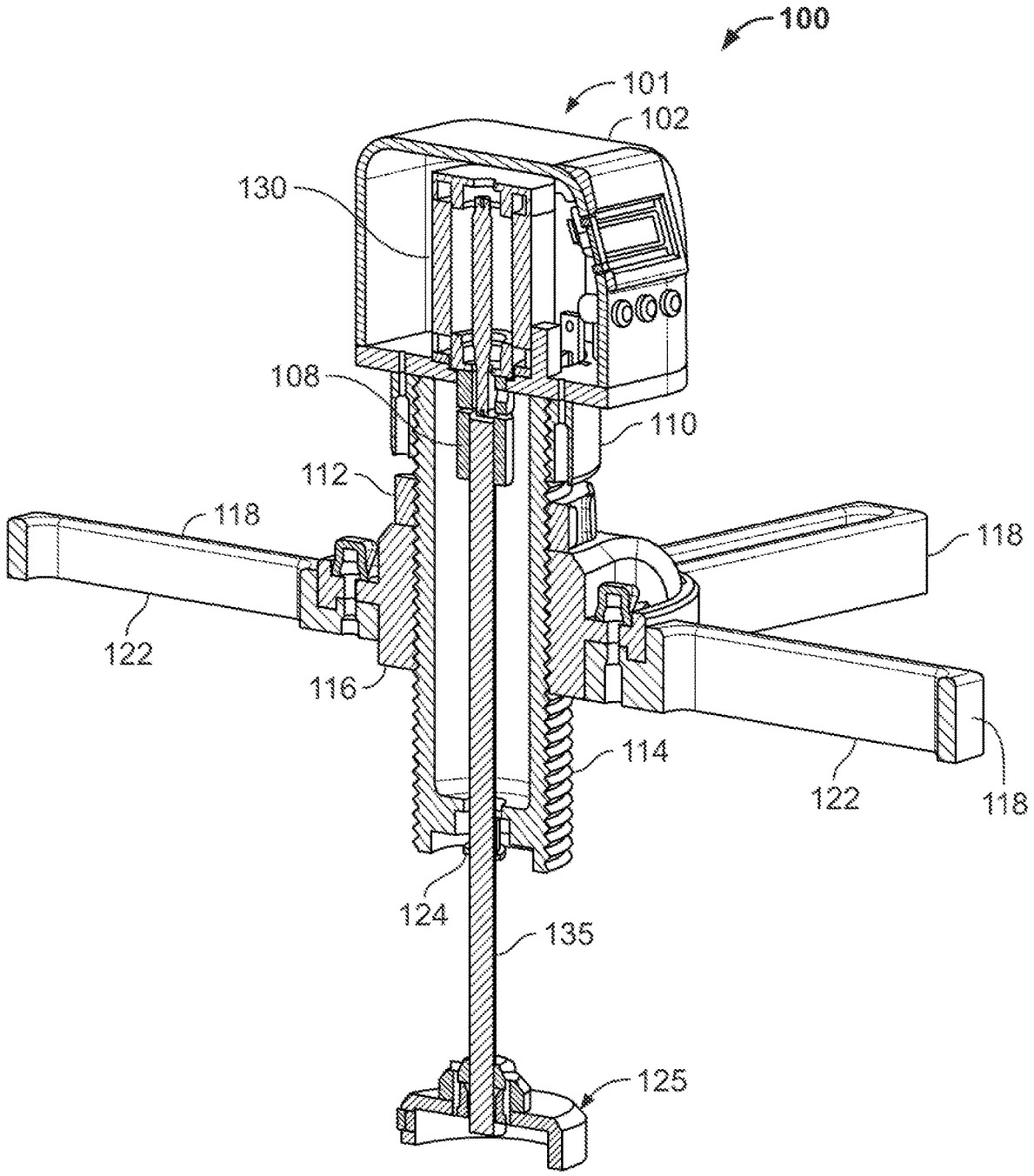

FIGS. 4A and 4B illustrate different cross-sectional views of the example implementation of the valve lapping system 100 according to the present disclosure. FIG. 4A shows the valve lapping system 100 with the traveling block 115 positioned (for example, threaded) to the hollow core 105 at a bottom end of the core 105 opposite the controller 101. FIG. 4B shows the valve lapping system 100 with the traveling block 115 positioned (for example, threaded) to the hollow core 105 at a top end of the core 105 adjacent the controller 101, thus showing a linear distance with which the traveling block 115 can be moved to accommodate different valve sizes.

As shown in these figures, the threaded rod 135 is coupled, through a bearing 124, to a motor coupling 108 (also shown in FIGS. 3A-3C). The motor coupling 108 is also connected to a shaft of electric motor 130, which is enclosed within housing 102. One or more additional bearings can also be used to couple the electric motor 130 to the motor coupling 108 (and thus the threaded rod 135). Rotation and torque produced by the motor 130, therefore, can be transferred to the threaded rod 135 through the motor coupling 108 and then to the bracket 125. Rotation of the bracket 125 is thus transferred to a lapping block secured within the bracket 125 (as discussed with reference to FIGS. 5A-5E) so that the lapping block can rotate or oscillate in contact with a sealing surface of a valve during a lapping operation.

Figure 5A:
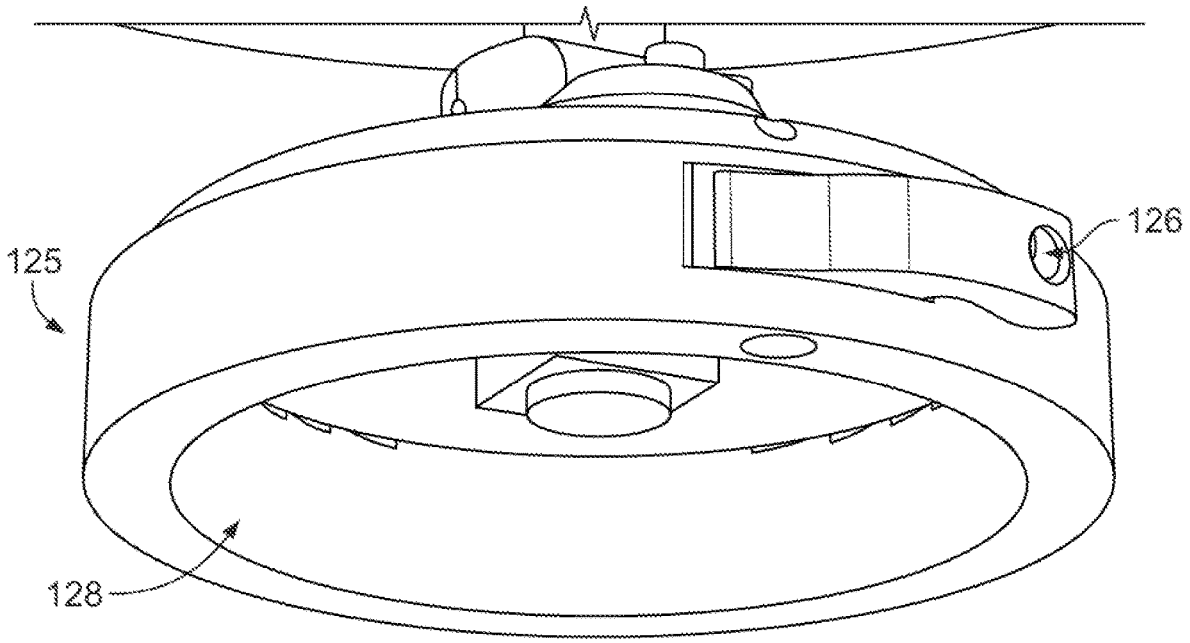
FIGS. 5A-5E illustrate different views of a lock assembly to secure a lapping block (or plate) into a valve lapping system according to the present disclosure.
Figure 5B:
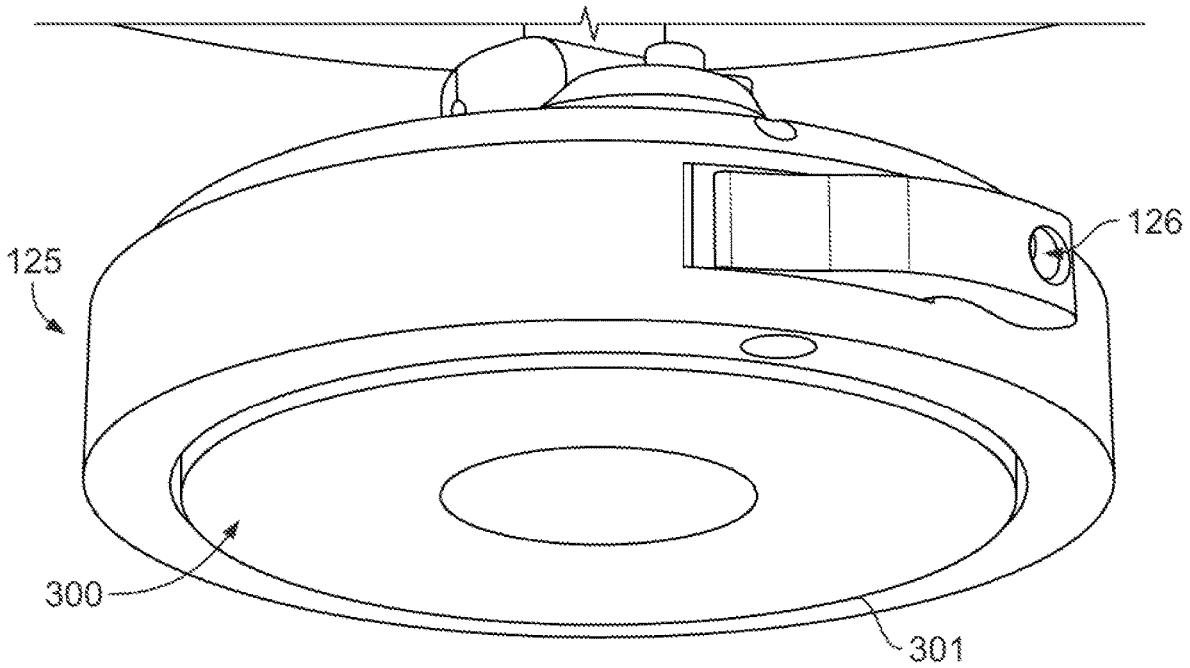

FIGS. 5A-5E illustrate different views of a lock assembly to secure a lapping block (or plate) into the valve lapping system 100 (or 200) according to the present disclosure. FIGS. 5A and 5B show a view of the bracket 125 that includes an opening 128 (for example, circular opening in this example but other shapes are also contemplated) sized to receive a lapping block 300 therein. In some aspects, the lapping block 300 includes an abrasive outer surface 301 that, when moved (rotated or oscillated) against a sealing surface of a valve (such as a seat or otherwise), acts to clean and/or resurface the sealing surface (for example, a valve nozzle surface) to remove damages or scratches. As further shown in these figures, a lock assembly 126 is positioned on the bracket 125 and, as explained herein, is operable to secure the lapping block 300 into the circular opening 128 such that rotation or oscillation of the bracket 125 will also rotate or oscillate the lapping block 300.

Figure 5D:
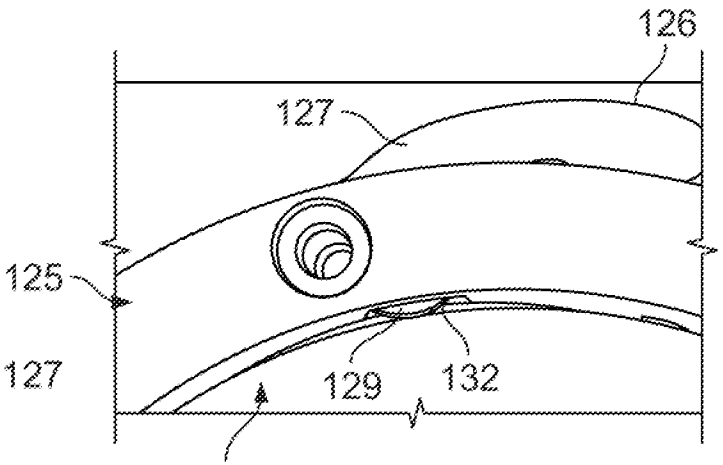
Figure 5E:
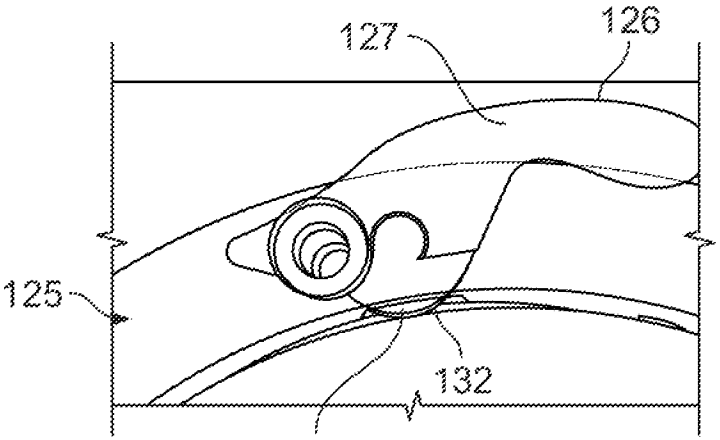
Figure 5C:
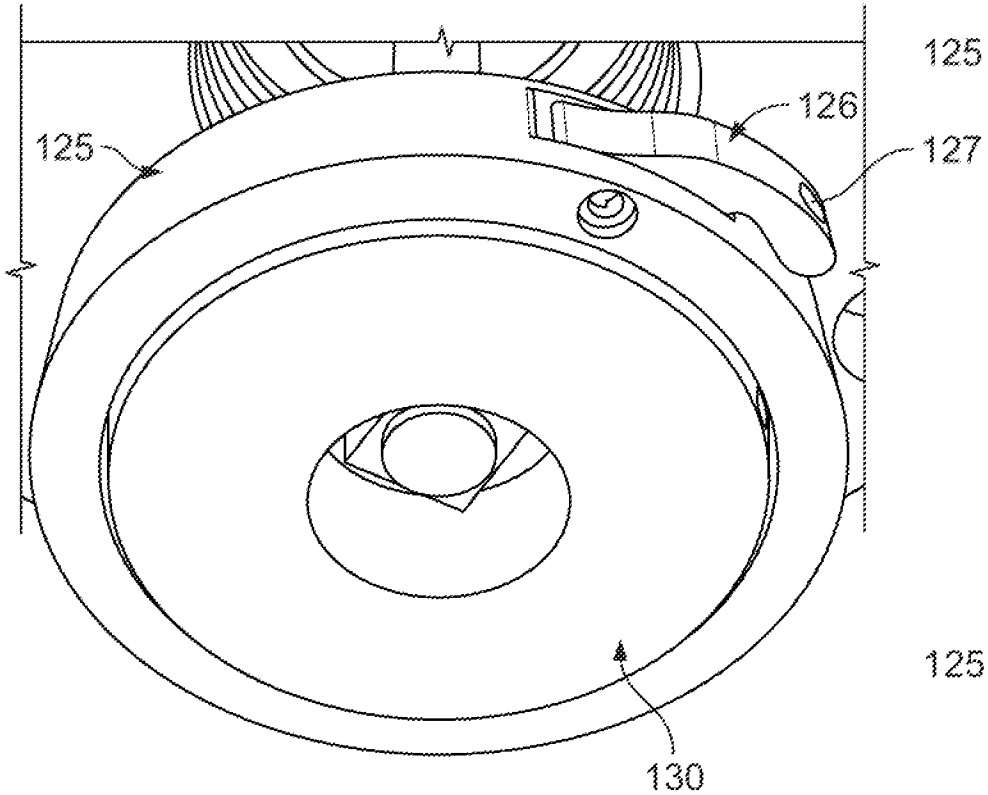

As shown in FIGS. 5C-5E, the lock assembly 126 includes a lever 127 that extends through the bracket 125 and is coupled or integrally formed with a tab 129 that extends into the circular opening 128 through a slot 132 in the bracket 125. When the lock assembly 126 is operated, the tab 129 contactingly secures the lapping block 300 into the circular opening 128 and the bracket 125. For example, when the lapping block 300 is placed in the circular opening 128, the lever 127 can be rotated (for example, clockwise in the views of FIGS. 5D and 5E) so that the tab 129 also rotates (clockwise) to contact the lapping block 300. The full lock assembly 126 is shown in FIG. 5E, with a portion that would be hidden and enclosed within the circumferential wall of the bracket 125 being exposed for illustrative purposes.

FIG. 6 is a schematic illustration of an example implementation of the controller 101 (or control system 101) of the valve lapping system 100 (or 200) according to the present disclosure. As shown in this figure, the controller 101 includes the housing 102 and a display 104 (for example, an LCD display) along with several control buttons 134*a*-134*e* (or knobs or switches, or other manually operated control inputs in this example). Other components of the controller 101, such as the electric motor 130, motor controller, hardware processors (options) are enclosed within the housing 102. Other optional components, such as tangible, non-transitory computer-readable memory to store instructions on operating the controller 101 can also be included in the housing 102 and communicably coupled to, for instance, one or more processors or processing devices.

In this example, the controller 101 includes five control buttons 134*a*-134*e*. Control button 134*a* can be a direction control. For example, activation (or deactivation) of control button 134*a* can cause the electric motor 130 to switch from rotating in a first direction (thereby rotating the threaded rod 135, bracket 125, and lapping block 300 in the first direction) to rotating in a second, opposite direction (thereby rotating the threaded rod 135, bracket 125, and lapping block 300 in the second direction).

Control button 134*b* can be a speed increase control. For example, activation of control button 134*b* can cause a rotational speed of the electric motor 130 to increase, thereby increasing a rotational speed of the threaded rod 135, bracket 125, and lapping block 300. Similarly, control button 134*c* can be a speed decrease control. For example, activation of control button 134*c* can cause a rotational speed of the electric motor 130 to decrease, thereby decreasing a rotational speed of the threaded rod 135, bracket 125, and lapping block 300.

Control button 134*d* can be an off control. For example, activation of control button 134*d* can cease all rotational speed of the electric motor 130 (gradually or instantly), thereby also ceasing a rotational speed of the threaded rod 135, bracket 125, and lapping block 300. Control button 134*e* can be an on control. For example, activation of control button 134*e* can turn the valve lapping system 100 (or 200) on, either at a low rotational speed or no rotational speed of the motor 130 (which is then activated by control button 134*b*).

FIGS. 7A-7D are illustrations that show an example process for using a valve lapping system according to the present disclosure. In these figures, valve lapping system 200 is shown; however, the example process can also be implemented with valve lapping system 100 in similar fashion. In some aspect, selection of the specific set of arms (118 or 218) for traveling block 115 can occur prior to the example process and, for example, be based on a size of the valve for which the lapping process is to be applied. This step can also be performed during the example process described here.

Figure 7A:
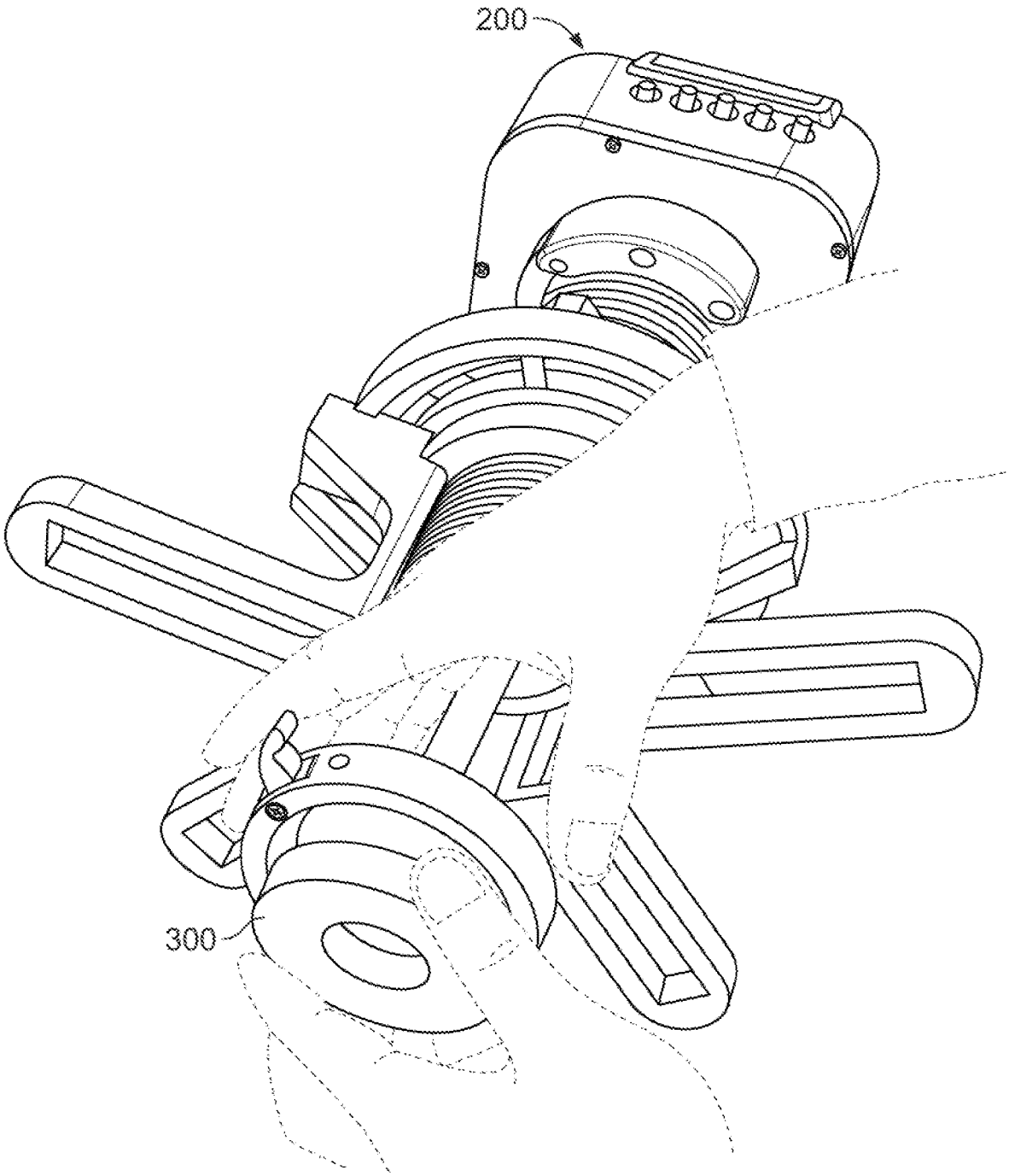
FIGS. 7A-7D are illustrations that show an example process for using a valve lapping system according to the present disclosure.

First, as shown in FIG. 7A, the lapping block 300 is inserted into the circular opening 128 of the bracket 125. Generally, the lapping block 300 is selected for its size relative to the valve for which the lapping process is to be applied. In some aspects, the bracket 125 of the valve lapping system 200 is also selected (or changed) based on the size (for example, diameter, thickness, or both) of the lapping block 300.

Figure 7B:
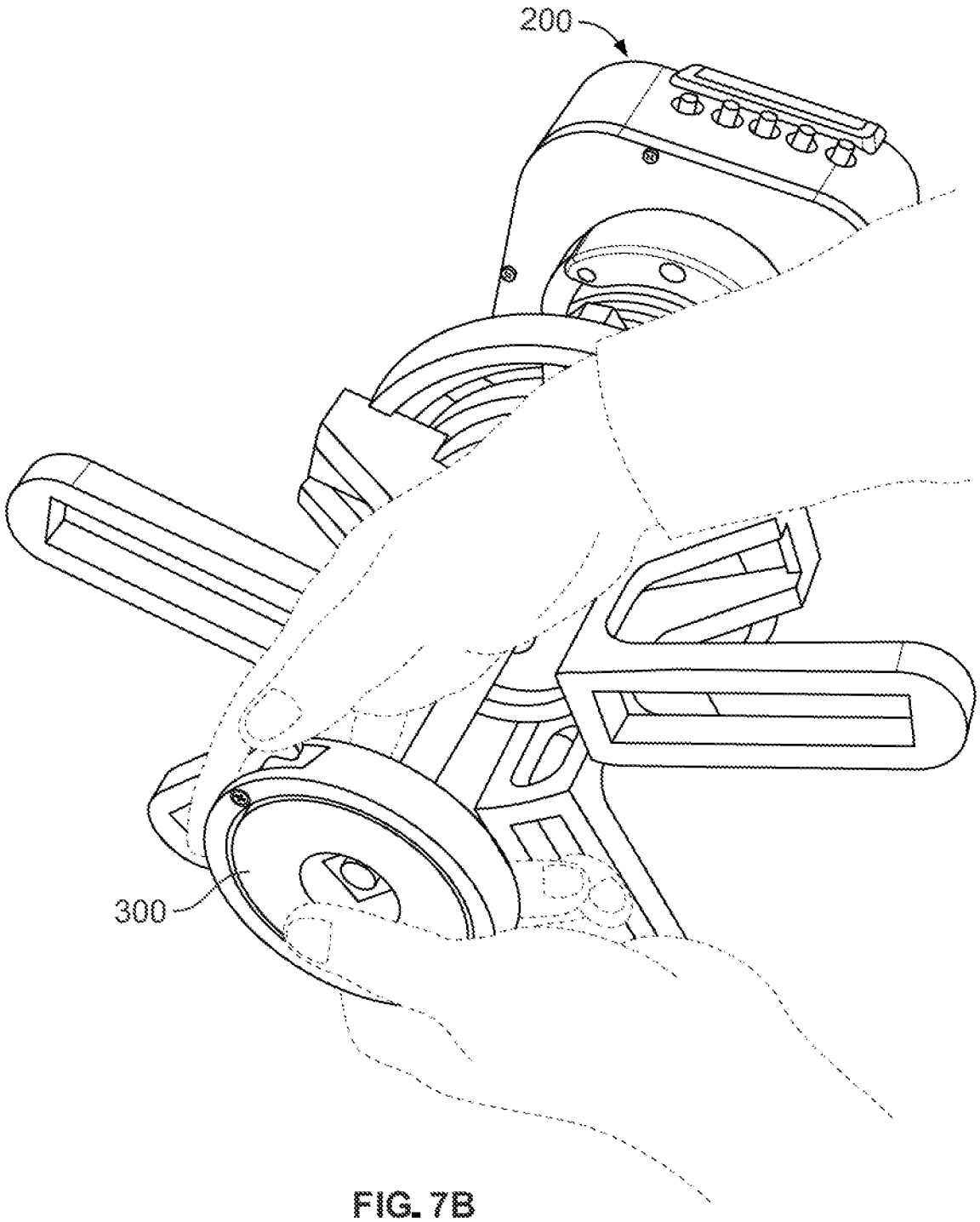

Second, as shown in FIG. 7B, the lapping block 300 can be secured into the bracket 125 by operation of the lock assembly 126. For example, the lever 127 of the lock assembly 126 can be rotated to secure the lapping block 300 into the bracket 125 with the tab 129.

Figure 7C:
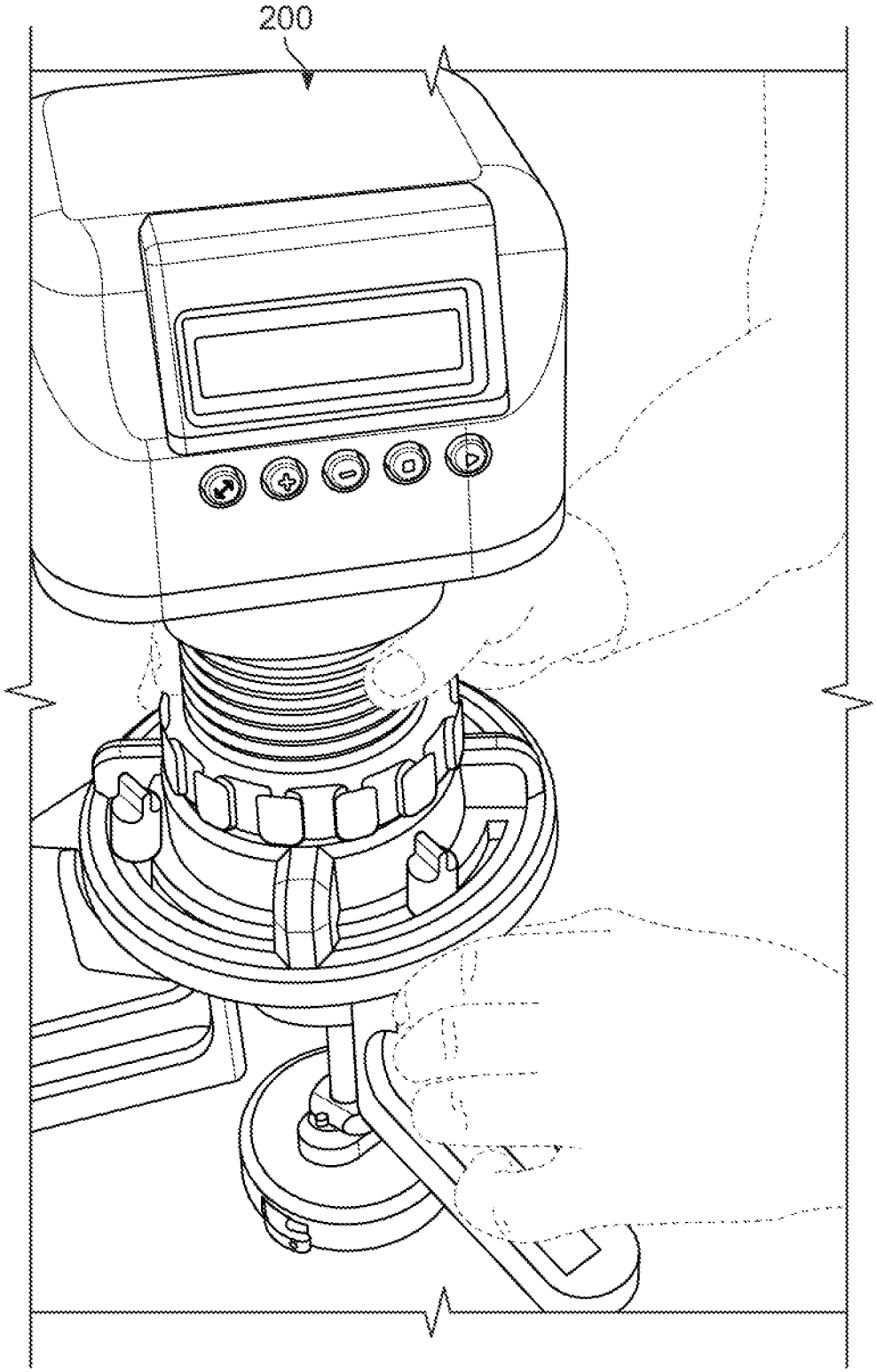

Third, as shown in FIG. 7C, each arm 218 can be adjusted along the arc channels 150 (and secured through bolted connections 152) so that each channel 222 aligns with a flange bolt or threaded rod connection of the valve. Once the channels 222 are correctly aligned (radially about the hub 116) to match the locations of the valve flange bolts or threaded rod connections, the bolted connections 152 can be tightened to lock the arms 218 into place (radially about the hub 116).

Figure 7D:
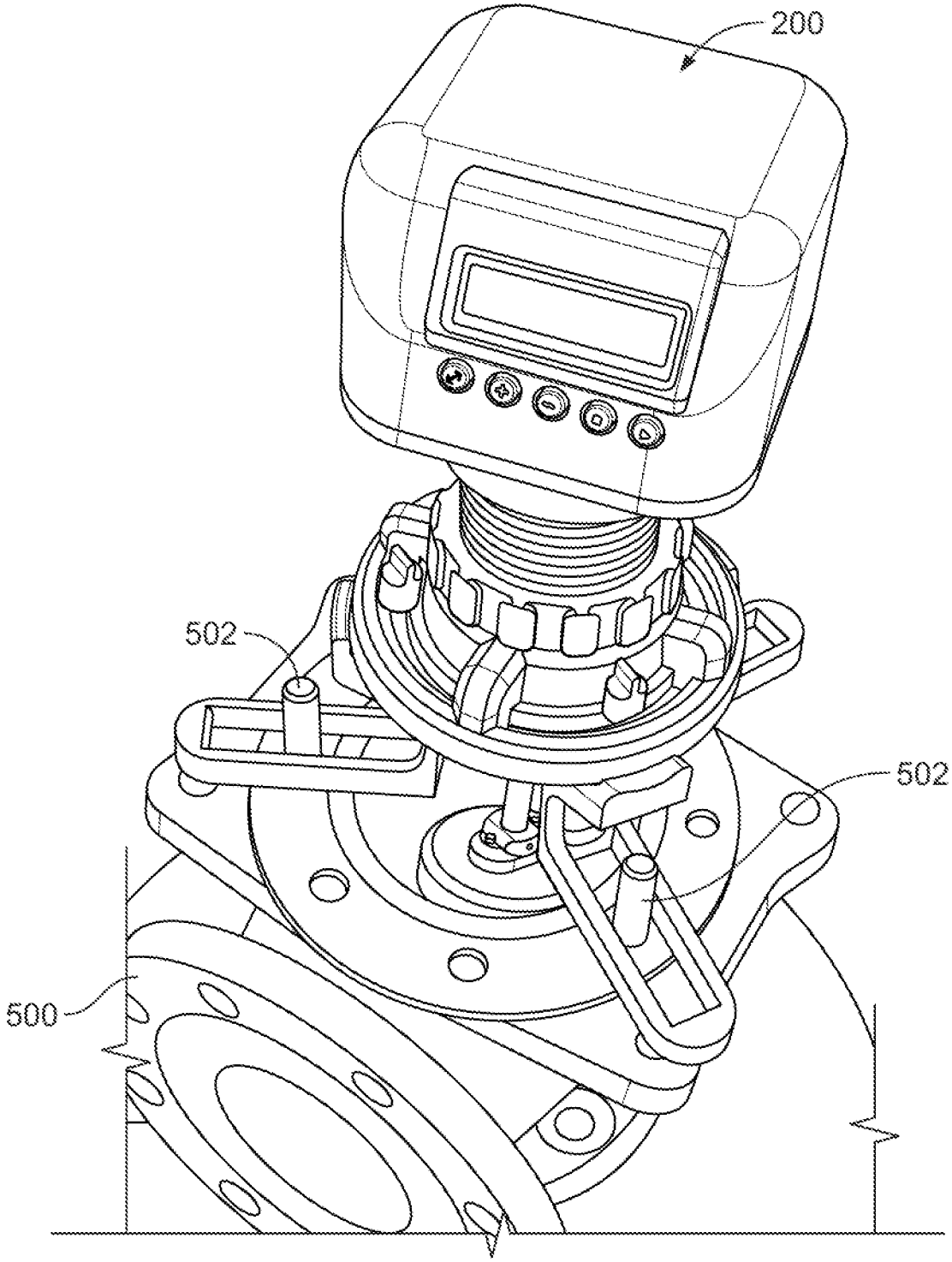

Fourth, as shown in FIG. 7D, the valve lapping system 200 is secured to a valve 500. Flange bolts 502 extend through the channels 222 (one per channel in this example), where nuts 120 are then threaded thereon to secure the valve lapping system 200 to the valve 500. In this secured position, the lapping block 300 is in contact with (and resting on) the valve surface to be treated. Now, a lapping operation of valve 500 with the valve lapping system 200 can commence.

To begin the lapping operation, the valve lapping system 200 can be turned on by activating the control button 134*e*. While on, the electric motor 130 in the controller 101 may be at no speed or a very low speed unsuitable for the lapping operation. Next, the rotational speed of the electric motor 130 can be increased by manipulation of the control button 134*b*. Rotation produced by the electric motor 130 is transferred to the lapping block 300 through the threaded rod 135 and bracket 125. Control buttons 134*b* and 134*c* can be manipulated until a desired rotational speed of the lapping block 300 is reached and then, subsequently adjusted as needed. Optionally, control button 134*a* can be manipulated to reverse a rotational direction of the electric motor 130 (and thus lapping block 300). Such a change of rotational direction can result in oscillating movement of the lapping block 300 on the valve surface. In some aspects, speed and direction control of the electric motor 130 can be programmed into the controller 101 and performed in an automated fashion once the valve lapping system 200 is turned on.

While this specification contains many specific implementation details, these should not be construed as limitations on the scope of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described may include more steps or fewer steps than those described. Further, the steps in such example operations, methods, or processes may be performed in different successions than that described or illustrated in the figures. Accordingly, other implementations are within the scope of the following claims.

What is claimed is:

1. A valve lapping system, comprising:

an electric motor at least partially enclosed in a housing;

a hollow core coupled to the housing and comprising a threaded outer surface;

a traveling block that comprises a hub configured to thread onto the threaded outer surface of the hollow core and a plurality of arms that extend from the hub, each arm comprising a channel configured to receive a portion of a valve;

a threaded rod that extends through the hollow core and couples to the electric motor; and a bracket coupled to the threaded rod and comprising an opening sized to receive a lapping block that comprises an abrasive surface configured to modify a sealing surface of the valve, the bracket and lapping block configured to rotate or oscillate, in combination, based on operation of the electric motor to rotate or oscillate the threaded rod;

wherein the housing is configured to thread onto the threaded outer surface and comprises a plurality of control buttons to operate the electric motor such that the electric motor rotates or oscillates the threaded rod.

2. The valve lapping system of claim 1, wherein the bracket further comprises a lock assembly configured to secure the lapping block into the opening and to the bracket.

3. The valve lapping system of claim 1, wherein the portion of the valve comprises a flange bolt, the system further comprising a plurality of threaded nuts, each threaded nut configured to thread onto the flange bolt that extends through the channel to secure each arm to the valve.

4. The valve lapping system of claim 1, wherein:

each arm extends substantially linearly from the hub, or each arm comprises an L-shaped arm that extends from the hub.

5. The valve lapping system of claim 4, wherein the hub comprises a plurality of are channels, and each arm is secured to the hub with a bolted connection at one of the arc channels.

6. The valve lapping system of claim 4, wherein each arm is secured to the arm at a radially adjustable location with the bolted connection and the are connection.

7. The valve lapping system of claim 1, wherein the hub is configured to thread onto the threaded outer surface of the hollow core to adjust a distance between the hub and the housing based on a size of the valve.

8. The valve lapping system of claim 1, further comprising a controller that includes the electric motor, the controller comprising the plurality of control buttons.

9. The valve lapping system of claim 8, wherein the controller is configured to perform operations comprising:

based on activation of a first control button, turning the electric motor on; and based on activation of a second control button, turning the electric motor off.

10. The valve lapping system of claim 9, wherein the controller is configured to perform operations comprising:

based on activation of a third control button, adjusting a rotational speed of the electric motor to adjust a rotational speed of the bracket and the lapping block, in combination, based on operation of the electric motor at the adjusted rotational speed to rotate the threaded rod; and based on activation of a fourth control button, adjusting a rotational direction of the electric motor to adjust a rotational direction of the bracket and the lapping block, in combination, based on operation of the electric motor at the adjusted rotational direction to rotate the threaded rod.

11. A valve lapping method, comprising:

installing a valve lapping system onto a valve, the valve lapping system comprising:

an electric motor at least partially enclosed in a housing, a hollow core coupled to the housing and comprising a threaded outer surface, a traveling block that comprises a hub threaded onto the threaded outer surface of the hollow core and a plurality of arms that extend from the hub, each arm comprising a channel through which a portion of the valve extends, a threaded rod that extends through the hollow core and is coupled to the electric motor, and a bracket coupled to the threaded rod and comprising an opening into which a lapping block that comprises an abrasive surface is secured;

wherein the housing is configured to thread onto the threaded outer surface and comprises a plurality of control buttons to operate the electric motor such that the electric motor rotates or oscillates the threaded rod;

operating the electric motor to rotate or oscillate the bracket and lapping block, in combination, through rotation or oscillation of the threaded rod by the electric motor; and modifying a sealing surface of the valve with the rotating or oscillating lapping block.

12. The valve lapping method of claim 11, further comprising securing the lapping block into the opening and to the bracket with a lock assembly of the bracket.

13. The valve lapping method of claim 11, wherein installing the valve lapping system comprises:

installing the traveling block onto the valve such that flange bolts of the valve extend through respective channels of the arms; and installing a threaded nut onto each of the flange bolts to secure each arm to the valve.

14. The valve lapping method of claim 11, further comprising:

selecting arms of the traveling block that extend substantially linearly from the hub based on a size of the valve, or selecting arms of the traveling block that each comprises an L-shaped arm that extends from the hub based on the size of the valve.

15. The valve lapping method of claim 14, wherein the hub comprises a plurality of arc channels, and each arm is secured to the hub with a bolted connection at one of the are channels.

16. The valve lapping method of claim 14, further comprising:

adjusting a radial location of each arm in a respective arc channel; and securing each arm to the hub at the location with a bolted connection through the arc channel.

17. The valve lapping method of claim 11, further comprising threading the hub onto the threaded outer surface of the hollow core to adjust a distance between the hub and the housing based on a size of the valve.

18. The valve lapping method of claim 11, further comprising:

activating a first control button to turn the electric motor on; and activating a second control button to turn the electric motor off.

19. The valve lapping method of claim 18, further comprising:

activating a third control button to adjust a rotational speed of the electric motor to adjust a rotational speed of the bracket and the lapping block, in combination, based on operation of the electric motor at the adjusted rotational speed to rotate the threaded rod.

20. The valve lapping method of claim 18, further comprising:

activating a fourth control button to adjust a rotational direction of the electric motor to adjust a rotational direction of the bracket and the lapping block, in combination, based on operation of the electric motor at the adjusted rotational direction to rotate the threaded rod.

* * * * *